United States Patent [19]

Scherer et al.

[11] Patent Number: 4,984,655

[45] Date of Patent: Jan. 15, 1991

[54] LADDER ADJUSTMENT APPARATUS

[76] Inventors: Mark D. Scherer, 11313 Newland St., Westminster, Colo. 80020; Thomas A. Hoy, 2906 Stuart St., Denver, Colo. 80212

[21] Appl. No.: 483,846

[22] Filed: Feb. 23, 1990

[51] Int. Cl.[5] ..... E06C 7/44

[52] U.S. Cl. ..... 182/204; 182/111

[58] Field of Search ..... 182/201, 202, 203, 204, 182/205, 111

[56] References Cited

U.S. PATENT DOCUMENTS

| | | | |
|---|---|---|---|
| 1,033,685 | 7/1912 | Eskew | 182/205 |
| 1,589,743 | 6/1926 | Clary | 182/205 |
| 1,609,257 | 11/1926 | Lazear | 182/205 |
| 1,705,000 | 3/1929 | Brandt | 182/204 |
| 2,969,126 | 1/1961 | Gardner | 182/202 |
| 3,165,170 | 1/1965 | Blaney | 183/203 |
| 3,554,321 | 1/1971 | Stedman | 182/201 |
| 4,143,742 | 3/1979 | Fernandez | 182/201 |
| 4,209,078 | 6/1980 | Gerber | 182/203 |
| 4,607,726 | 8/1986 | Davis et al. | 182/204 |
| 4,671,383 | 6/1987 | Huang | 182/204 |

*Primary Examiner*—Reinaldo P. Machado
*Attorney, Agent, or Firm*—Henderson & Sturm

[57] ABSTRACT

A ladder adjustment apparatus (10) which is designed to be secured to the rungs (101) of a ladder (100) whereby the apparatus (10) may be laterally shifted on the rungs (101) to position the apparatus (10) adjacent either leg (102) of the ladder without the need for physically detaching the apparatus (10) from the ladder (100).

10 Claims, 2 Drawing Sheets

LADDER ADJUSTMENT APPARATUS

TECHNICAL FIELD

The present invention relates to the field of ladder adjustment mechanisms, and in particular to a single adjustable leg member that is used to level a ladder on an uneven surface.

BACKGROUND ART

This invention was the subject matter of Document Disclosure Program Registration No. 221581 which was filed in the U.S. Patent and Trademark Office on Mar. 6, 1989.

As can be seen by reference to the following U.S. Pat. Nos.: 3,554,321; 4,143,742; 4,607,726; and 2,969,126; the prior art is replete with myriad and diverse ladder extension apparatus that are intended to level a ladder on an uneven surface.

While all of the aforementioned prior art constructions are more than adequate for the basic purpose and function for which they have been specifically designed, these devices are also limited in their basic design in that they fall into one of two categories. The most common category being the plural legal adjustment variety wherein both legs of the ladder can be adjusted independently; and the other category being the single leg exterior mounted variety wherein a detachable adjustment mechanism can be mounted on the outboard surface of either of the legs of the ladder.

In the first instance the plural leg adjustment devices are very costly to incorporate into the ladder structure, and usually contain a large number of components which are subject to structural failure which will render the ladder inoperative for uneven surfaces.

In the second instance the single leg variety is typically mounted on the outboard surface of the ladder legs which of necessity extends the width of the ladder, and the outwardly projecting portions of the adjustment mechanism tend to bump into movable and stationary surfaces as the ladder is being moved to and from a job site.

Furthermore there are certain instances wherein the standard width of a ladder is unsuitable for either variety of adjustment mechanism due to the narrowness and/or uneven contour of the workplace.

As a consequence of the foregoing situation there has existed a longstanding need for a new type of ladder adjustment mechanism that will overcome the shortcomings of the prior art constructions and provide a ladder adjustment device that is both adjustable and laterally translatable relative to the rung of a ladder. The provision of such a construction is a stated objective of the present invention.

DISCLOSURE OF THE INVENTION

Briefly stated, the ladder adjustment apparatus comprises a mounting unit, an extension unit, and a plurality of locking units which cooperate with one another to provide an adjustment mechanism that is selectively positioned on and laterally displaceable with respect to the rungs of a ladder; wherein the adjustment apparatus is operatively disposed inside the legs of the ladder so as to accommodate narrow and/or peculiarly configured spaces.

As will be explained in greater detail further on in the specification, this particular arrangement offers a variety of advantages over the prior art constructions in that it is significantly less expensive to employ relative to the plural leg adjustment devices yet serves the same basic purpose; and, this arrangement does not project beyond the sides of the ladder as is the case with the single leg variety, coupled with the face that it is not necessary to physically remove the apparatus of this invention in order to switch the adjustment device from one side of the ladder to the other, as is the case with a typical single leg adjustment device.

In addition, this invention further contemplates the use of a stationary rung locking unit and an adjustable rung locking unit whereby the lock units can accommodate ladders having different rung spacings. Furthermore since this invention is disposed inside the legs of the ladder provisions have been made to orient the foot of the extension unit perpendicular to and substantially beneath the leg of the ladder whose end is theoretically being lengthened.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 2:
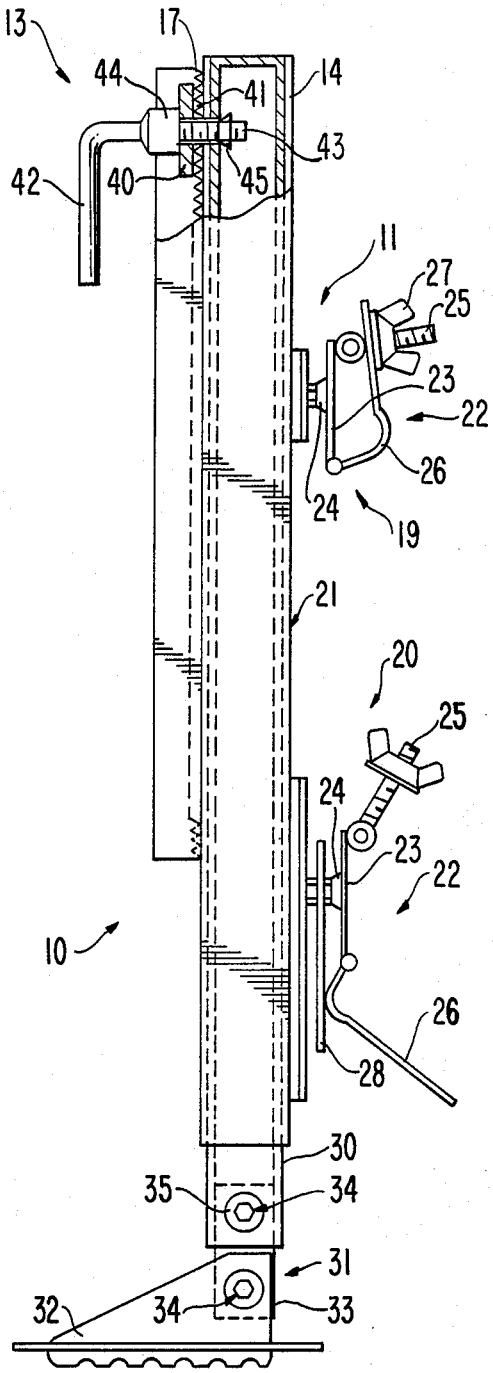
FIG. 2 is a side plan view of the apparatus installed on a ladder.

As can be seen by reference to the drawings, and in particular to FIG. 2, the ladder adjustment apparatus that forms the basis of the present invention is designated generally by the reference numeral (10).

The ladder adjustment apparatus comprises in general: a mounting unit (11), an adjustable leg unit (12) and a locking unit (13). These units will now be described in seriatim fashion.

Figure 3:
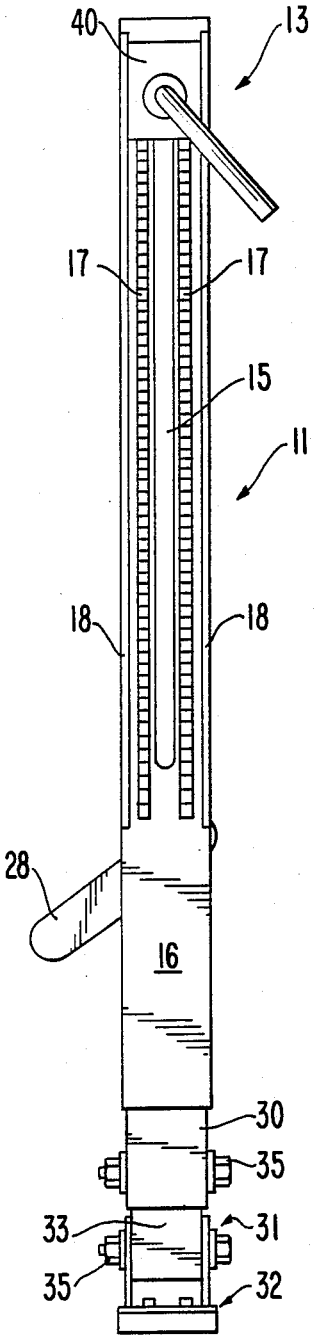
FIG. 3 is an isolated rear plan view of the apparatus.
Figure 4:
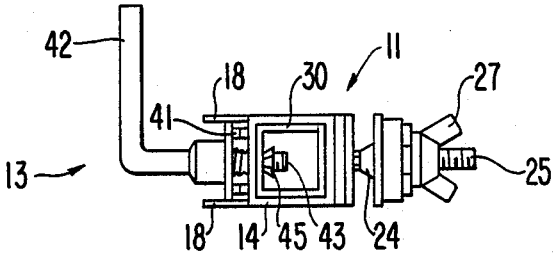
FIG. 4 is a top plan view of the apparatus.

As can best be seen by reference to FIGS. 2 through 4 the mounting unit (11) comprises a first generally hollow outer tubing member (14) having an elongated aperture (15) formed on and depending downwardly from the upper portion of one of the sides (16) of the tubing member (14). In addition a pair of toothed strip elements (17) are disposed on opposite sides of the elongated aperture (15) and flanked by a pair of elongated flanges (18) which project outwardly from the first tubing member (14).

Furthermore the mounting unit (11) also comprises a stationary rung capturing member (19) and an adjustable rung capturing member (20) which are operatively secured to the first tubing member (14) and adapted to releasably and operatively engage the mounting unit (11) to the rungs (101) of a ladder (100).

Turning now particularly to FIG. 2 it can be seen that the stationary (19) and adjustable (20) rung capturing members are both mounted on the inboard side (21) of the first tubular member (14) and are provided with a rotatable capture element (22) including a base (23) mounted on a stem (24) and provided on the upper and lower ends with a hinged bolt member (25) and a hinged latch member (26) dimensioned to receive the bolt member (25); wherein a threaded nut (27) is provided to captively engage one of the rungs (101) of the ladder (100) intermediate the base (23) and the hinged latch member (26) when the nut (27) is operatively engaged with the hinged bolt member (25) and the latch member (26) as depicted in the upper portion of FIG. 2.

In addition the stationary rung capturing member (19) is fixedly yet rotatably secured relative to the inboard side (21) of the first tubing member (14); while the adjustable rung capturing member (20) has an elongated stem (24) which extends into the tubing member (14) and is vertically translatable relative thereto; wherein, the adjustable rung capturing member (20) is further provided with a lever-actuated lock mechanism (28) which will selectively immobilize the adjustable rung capturing member (20) at a selected height relative to the first tubing member (14).

By now it should be appreciated that given the fact that different ladders (100) have different spacing between the rungs (101), the foregoing arrangement of both a stationary (19) and an adjustable (20) rung capturing member allow the mounting unit (11) to be quickly adjusted to adapt to a wide range of different rung spacings when the apparatus (10) is installed on a particular ladder (100).

Figure 1:
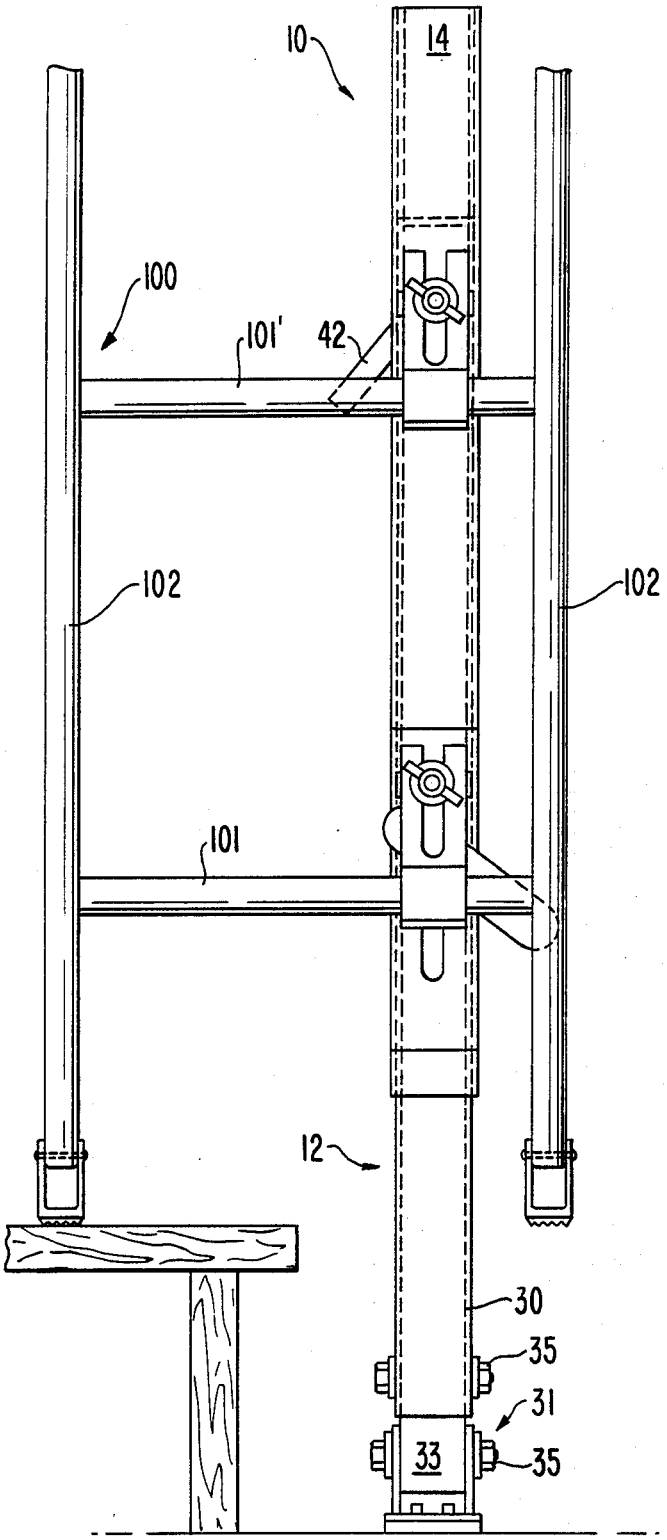
FIG. 1 is a front plan view of the apparatus installed on a ladder.

As shown in FIGS. 1 through 3 the adjustable leg unit (12) comprises a second reduced diameter generally rectangular hollow inner tubing member (30) which is dimensioned to be received within the first tubing member (14) wherein the second tubing member (30) is further provided with an elongated foot element (31) whose purpose and function will be described presently..

Given the fact that the ladder adjustment apparatus (10) of this invention relies on operative engagement with the rungs (101) of the ladder (100) to provide support, it is conceivable that the orientation of the apparatus (10) under some circumstances will require that the vertical axis of the inner (30) and outer (14) tubing members will be spaced from the closed vertical leg (102) of the ladder.

In order to compensate for this situation and to ensure that the adjustment apparatus (10) provides the most stable support necessary, this invention has been designed to accommodate the selective positioning of the foot element (31) relative to the inner tubing member (30).

As shown in the lower portions of FIGS. 2 and 3, the foot element (31) comprises an elongated foot member (32) pivotally attached to a short square tubular member (33) which is dimensioned to be slideably received in the lower end of the second tubular member (30). In addition both the upper portion of the tubular member (33) and the lower portion of the second tubing member (30) are provided with a plurality of aligned apertures (34) which are dimensioned to receive a locking pin (35) for selectively positioning the foot member (32) outwardly from any one of the four sides of the inner tubing member (30).

As can best be seen by reference to FIGS. 2 through 4, the locking unit (13) comprises a generally rectangular locking plate (40) having a plurality of teeth (41) dimensioned to engage the toothed strip elements (17) on the outer tubing member (14); wherein the locking plate (40) is dimensioned to be slideably received between the flanges (18) on either side of the elongated aperture (17) on the first tubing member (14).

In addition the locking unit (13) comprises an elongated handle member (42) having an elongated threaded rod (43) which extends through the aperture (17) on the outer tubing member (14) and into a suitably threaded aperture (not shown) on the inner tubing member (30). Furthermore, the handle member (42) is provided with an enlarged shoulder (44) at the juncture of the handle member (42) and the threaded rod (43) wherein the outboard end of the threaded rod (43) is provided with a spring biased washer assembly (45) for biasing the locking plate (40) against the handle shoulder (44).

When it is desired to install the ladder adjustment apparatus (10) on a ladder (100) the stationary rung capturing member (19) is first attached to one of the rungs (101) of the ladder (100) whereupon the adjustable rung capturing member (20) is adjusted to engage another rung (101') on the ladder. Then the inner (30) and outer (14) tubing members are laterally shifted relative to the captured rungs (101)(101') and the leg (102') that is to be theoretically lengthened by employing the apparatus.

Once the inner (30) and outer (14) tubing members are disposed in their intended position on the ladder (100) the threaded nut (27) is tightened on the bolt member (25) to ensure that the apparatus (10) will not shift laterally while in use.

At this point the handle member (42) is rotated to allow the teeth (41) of the locking plate (40) to be spaced from the tooth strip elements (17) on the outer tubing member (14). This allows the inner tubing member (30) to slide freely relative to the outer tubing member (14) such that the adjustable leg unit (12) may be positioned at the desired height relative to the mounting unit (11). Now the handle member (42) is rotated in the opposite direction to engage the teeth (41) of the locking plate (40) with the toothed strips (17) on the outer tubing member (14) to lock the inner tubing member (14) in a well recognized fashion.

At this juncture the foot member (32) may be selectively positioned relative to the sides of the inner tubing member (30) and the ladder (100) should be virtually perfectly aligned for the uneven surface environment in which it is intended to be used.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

We claim:

1. A ladder adjustment apparatus for ladders having a pair of vertical legs connected together by rungs wherein the ladder adjustment apparatus comprises:

an outer tubing member provided with a pair of rung capturing members which are adapted to captively engage rungs on said ladder; wherein the pair of rung capturing members comprise: a stationary rung capturing member disposed at a fixed location on the outer tubing member; and, an adjustable rung capturing member which is vertically displaceable relative to said outer tubing member; wherein both of said rung capturing members are rotatably disposed relative to said outer tubing member;

an inner tubing member slideably disposed within said outer tubing member and provided with a foot element on the lower end of the inner tubing member; and a locking unit operatively associated with said inner and outer tubing members for varying the relative position between the inner and outer tubing members to adjust the vertical height of the apparatus.

2. The apparatus as in claim 1 wherein said foot element comprises an elongated foot member pivotally attached to a tubular member.

3. The apparatus as in claim 2 wherein said tubular member and the lower portion of said inner tubing member are provided with a plurality of aligned apertures which are dimensioned to receive a locking pin for varying the alignment of the foot element relative to the inner tubing member.

4. The apparatus as in claim 1 wherein said inner and outer tubing members have a generally rectangular configuration.

5. The apparatus as in claim 4 wherein the outer tubing member is provided with an elongated aperture having a pair of toothed strip elements disposed along the sides of the elongated aperture.

6. The apparatus as in claim 5 wherein the locking unit comprises:

a generally rectangular locking plate having a plurality of teeth dimensioned to engage the toothed strips on said outer tubing member.

7. The apparatus as in claim 6 wherein the locking unit further comprises:

an elongated handle member having a threaded rod which passes through said locking plate and the elongated aperture in the outer tubing member and into the inner tubing member for moving the toothed surfaces into and out of engagement with one another.

8. The apparatus as in claim 7 wherein the outer tubing member is further provided with a pair of flanges which flank the toothed strips; and wherein the flanges are spaced from one another to slideably receive the generally rectangular locking plate.

9. The apparatus as in claim 1 wherein each of said rung capturing members comprises:

a base mounted on a stem that is operatively attached to the outer tubing member;

a bolt member and a latch member hingedly connected on the opposite ends of the base, wherein the latch member is configured to receive the bolt member; and, locking means for captively engaging the bolt member relative to the latch member.

10. The apparatus as in claim 1 wherein the adjustable rung capturing member is provided with a lock mechanism.

* * * * *